United States Patent [19]

De Bortoli

[11] Patent Number: 5,065,480

[45] Date of Patent: Nov. 19, 1991

[54] FASTENING AND ADJUSTING DEVICE, PARTICULARLY FOR SKI BOOTS

[75] Inventor: Giuseppe De Bortoli, Montebelluna, Italy

[73] Assignee: Nordica S.p.A., Montebelluna, Italy

[21] Appl. No.: 519,576

[22] Filed: May 7, 1990

[30] Foreign Application Priority Data

May 15, 1989 [IT] Italy ..... 82541 A/89

[51] Int. Cl.[5] ..... A43C 11/00

[52] U.S. Cl. ..... 24/68 SK; 24/71.2

[58] Field of Search ..... 24/68 SK, 68 R, 68 B, 24/71.1, 71.2; 36/50; 242/99, 107.6

[56] References Cited

U.S. PATENT DOCUMENTS 2,518,902 8/1950 King ..... 242/99 X 4,433,456 2/1984 Baggio ..... 24/71.1 X 4,619,057 10/1986 Sartor et al. ..... 24/68 SK 4,680,878 7/1987 Pozzobon et al. ..... 24/68 SK X 4,796,829 1/1989 Pozzobon et al. ..... 36/50 X 4,799,297 1/1989 Baggio et al. ..... 36/50 X 4,841,649 6/1989 Baggio et al. ..... 24/71.1 X

*Primary Examiner*—James R. Brittain

*Attorney, Agent, or Firm*—Guido Modiano; Albert Josif

[57] ABSTRACT

Fastening and adjusting device, particularly usable in ski boots comprising a winder for at least one traction element. The peculiarity of the device consists in the fact that a skier accessible knob is associated with said winder and has a first seat for a temporary locking element for locking to a body associated to said boot. Both the knob and the winder respectively have a second and third seats for a releasing element, for releasing said knob and body, and for a resilient member.

4 Claims, 1 Drawing Sheet

FASTENING AND ADJUSTING DEVICE, PARTICULARLY FOR SKI BOOTS

BACKGROUND OF THE INVENTION

The present invention relates to a fastening and adjusting device, particularly usable in ski boots.

Several fastening and adjusting devices are known nowadays having a round knob adapted to control a winder member for traction elements, such as cables for example, adapted to fasten the quarters or to secure the foot inside the boot.

To this aim, this same assignee has filed a U.S. Pat. No. 4,433,456 granted Feb. 28, 1984, which claimed a closure device comprising a casing associated to one of the flaps of the boot to be joined, and provided with a knob for actuating a winder spool. The spool winds at least one string associated with the other one of the flaps to be joined. The device furthermore comprises pawl means controlled by said knob and adapted to lock the spool in any position, by rotating the knob in one direction, and to release said spool, by rotating the knob in the opposite direction.

Although such a known device is reliable, it has nevertheless a few drawbacks: the pawl means, and the relative rotation pivot, are located at the casing; a rotating spool for winding a pair of cables and a pinion gear rotated by the knob are housed inside the casing; and therefore a toothed gear associated with the knob has been located outside the casing. This arrangement entails the use of a large number of components that consequently increases both the global cost of the device and the assembling operations.

It has been furthermore noted that the device has a large longitudinal size and it is consequently difficult to fit it into the boot structure.

Other devices of this type have temporary locking means of the winder, constituted by a combination of ratchet pawl engaging a toothed section, and the pawl as well as the relative rotation pivot are located at a ring interposed between a knob operated by the skier and a body on which said toothed section is provided.

Also in this case, there is a large number of components and a large longitudinal size.

SUMMARY OF THE INVENTION

The main aim of the present invention is therefore that of eliminating the above mentioned drawbacks in the known types, by providing a device that allows one or more of the traction elements to be optimally fastened and adjusted, for example for closing the quarters and for securing one or more of the boot inner pressers, and at the same time that has a limited number of components in order to limit the global costs and to simplify the assembling.

Within this aim, a further important object is that of providing a device having a very limited longitudinal size and therefore which can be easily fit into the boot structure without making the overall aesthetic aspect dull.

Not least object is which, in addition of providing a device that, to the above mentioned characteristics, adds the characteristic of allowing said one or more traction elements to be released rapidly.

The above mentioned aim and the objects, as well as others that will be more apparent hereinafter, are achieved by a fastening and adjusting device, particularly for ski boots. As defined in the appended claims.

BRIEF DESCRIPTION OF THE DRAWINGS

Further characteristics and advantages of the invention will be more apparent from the detailed description of a particular, but not exclusive, embodiment illustrated by way of non limitative example in the enclosed drawing, wherein.

DESCRIPTION OF THE PREFERRED EMBODIMENTS

Figure 1:
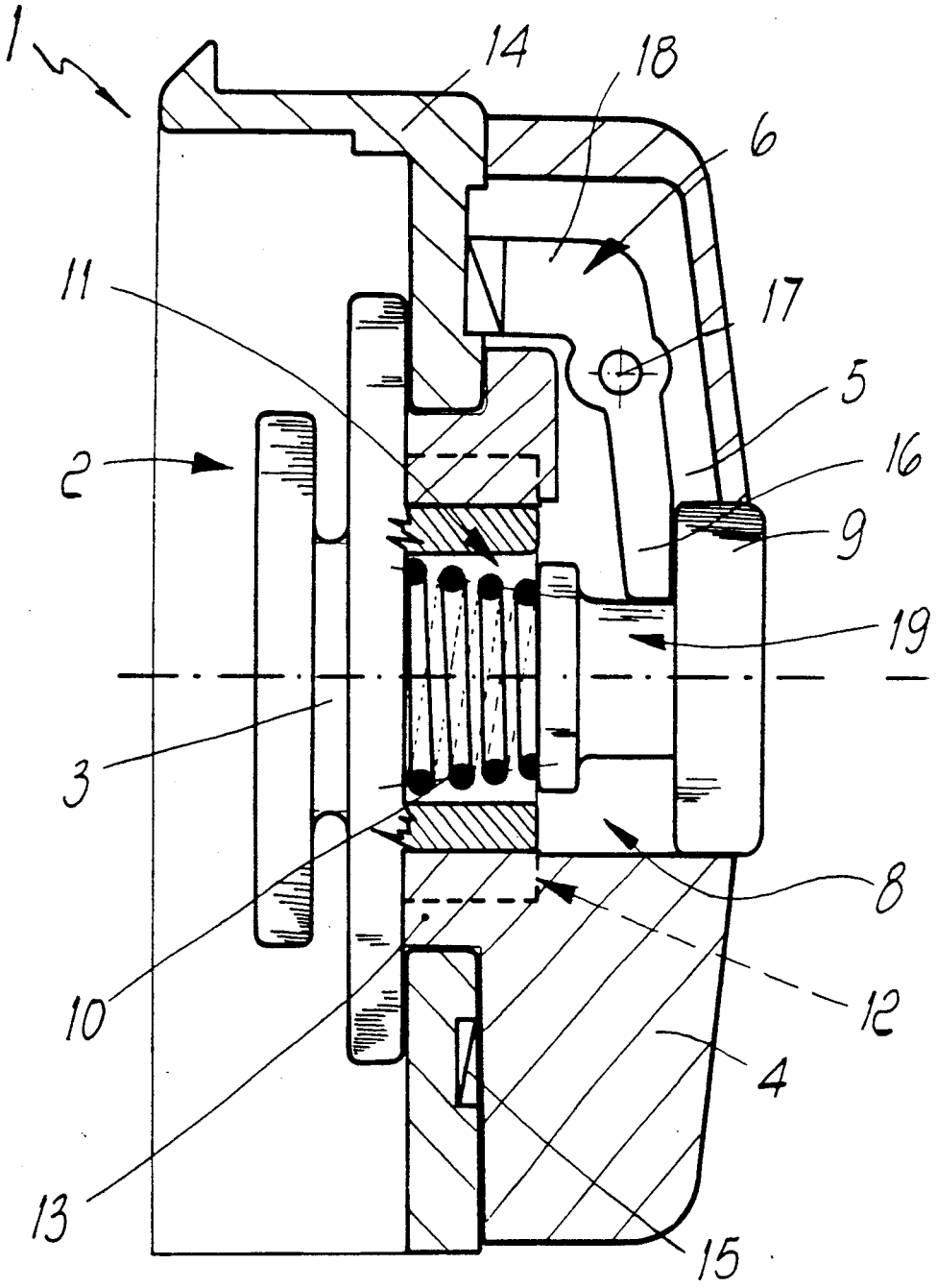
FIG. 1 illustrates the device in a view obtained by diametrally sectioning the knob.

With reference to the above drawing figure, the fastening and adjusting device, generally designated with the reference numeral 1, particularly usable with ski boots, comprises a winder 2 constituted by a spool having one or more annular races 3 for one or more traction elements, such as cables.

The device also comprises a knob 4 which has a circular shape.

Such knob 4 has a first seat 5 for a temporary locking element such as a pawl 6.

Said first seat 5 is substantially L-shaped and therefore has wings perpendicular to each other, one of the wings being perpendicular to the axis passing through the center of said knob.

The knob 4 furthermore has an axial second seat 8 for a releasing element constituted by a pushbutton 9 partially protruding outside the knob 4 at one end, and at the other end engaging a resilient member, such as a spring 10 located at a third seat 11 formed on said winder 2 and communicating with said second seat 8.

Said winder 2 has a first leg 12 associated with a second leg 13 of said knob 4.

A body 14 is rotatingly associated with said second leg 13 and to the boot which has an annular toothing 15 in the direction of the upper head of said knob.

The pawl 6 is substantially L-shaped and has a bigger first wing 16, which is hinged, by means of a pivot 17, inside said first seat 5 at the junction with the smaller second wing 18.

The first wing 16 has its end located at a groove 19 formed on said pushbutton 9, the second wing 18, by means of spring 10, is forced to engage the lower facing annular toothing 15 of body 14.

The interaction between said ends of said second wing 18 and the annular toothing 15 is such as to allow the rotation of the knob 4 in one direction.

The operation of the device is in fact the following: to a rotation in one set direction of the knob 4, follows the winding of the traction elements at the annular races 3 of the winder 2, because the knob 4, the pawl 6 and the winder 2 rotate together with the body 14; in this manner, the pawl 6, and therefore the pushbutton 9, work as a catch because of the interaction with the annular toothing 15.

As the desired fastening strength is reached, according to the selected adjusting, to release the device, it will be sufficient to press the pushbutton 9 in order to move the first wing 16 of the pawl 6 that will cause the second wing 18 of the pawl to disengage from the annular toothing 15.

The traction exerted by any optional string wound on the annular races 3 of the winder 2, or by an optional recovery spring associated with the cables, will cause the autonomous rotation of the winder in the opposite direction, allowing, for example, the easy opening of the quarters or the easy releasing of the foot.

It has thus been observed that the invention achieves the intended aim and objects, since a device is provided that allows, for example, to easily fasten the quarters and/or to secure the foot inside the boot. The device has a limited number of components which lowers the overall cost thereof and which allows a rapid and easy assembling.

The device furthermore has a very limited axial size that eases the insertion in the boot structure, keeping an optimal aesthetic aspect.

Naturally, the device according to the present invention is susceptible to numerous modifications and variations, all within the scope of the same inventive concept.

Thus, also the materials, as well as the dimensions of the single components constituting the device may be the most pertinent according to the specific needs.

I claim:

1. Fastening and adjusting device, particularly for ski boots, comprising at least one winder for at least one traction element and a skier accessible knob, said knob being connected to said at least one winder, said knob having a first seat for a temporary locking element for locking to a body which is rigidly connectable to said boot, said knob and winder having a second seat and a third seat respectively for a releasing means of said knob from said body and for a resilient member, said releasing means comprising a pushbutton at one end partially protruding outside said knob and at another end interacting with said resilient member located at said third seat formed in said winder and communicating with said second seat formed in said knob, said winder being constituted by a spool having one or more annular races for said at least one traction element, said at least one traction element comprising a cable, said knob being substantially circular, said temporary locking element being a pawl which is arranged in said first seat of said knob, said first seat being substantially L-shaped, wherein said pawl is substantially L-shaped and has a bigger first wing hinged by means of a pivot inside said first seat at a junction with a smaller second wing, and wherein said first wing has an end located at a groove formed on said pushbutton, said body being provided with an annular toothing which faces said knob, said second wing being forced to interact with the annular toothing of said body by means of said resilient member.

2. Device, according to claim 1, wherein said substantially L-shaped first seat has wings perpendicular to each other, one of said wings being perpendicular to a center rotation axis of said knob.

3. Device, according to claim 1, wherein said winder has a first leg associated with a second leg of said knob, said body being rotatably associated with said second leg, said body being rigidly connectable with said boot.

4. Device, according to claim 1, wherein said pushbutton is slideably associated in said second seat, said pawl interacting as a catch with said annular toothing.

* * * * *